United States Patent [19]

Riutta

[11] 4,340,248

[45] Jul. 20, 1982

[54] DEVICE FOR LOWERING CERAMIC LINERS INTO A CHIMNEY

[76] Inventor: Irving Riutta, R.D. #1, Box 293, Houghton, Mich. 49931

[21] Appl. No.: 202,986

[22] Filed: Nov. 3, 1980

[51] Int. Cl.[3] ..... B66C 1/54

[52] U.S. Cl. ..... 294/93

[58] Field of Search ..... 294/93, 81, 86 R, 86.24, 294/99 R, 88, 64 R

[56] References Cited

U.S. PATENT DOCUMENTS 3,544,151 12/1970 Stokes ..... 294/93

3,892,437 7/1974 Makinen ..... 294/93

*Primary Examiner*—James B. Marbert

*Attorney, Agent, or Firm*—Cullen, Sloman, Cantor, Grauer, Scott & Rutherford

[57] ABSTRACT

An apparatus is disclosed for lowering rectangular cored liners into a flue passage. The lowering apparatus includes a hydraulically actuated cross support cylinder releasably clamped between two opposite walls of the liner core. The cylinder ends have external, axially disposed rods each supporting a transverse pressure pad member. A piston, slidable in the cylinder, is actuated to extend one rod causing the pressure pad members to engage the opposite core walls and clamp the cross support cylinder in the liner core. The apparatus further includes a paired coextensive holding cable and flexible supply hose with one end of the cable connected by a stirrup-like sling arrangement to the pressure pad members. Uniformly spaced closed loops are formed in the cable at defined intervals for indicating to the user the arrival of the liner at a course depth and for temporarily securing the cable to a support. A fail-safe structure is adapted to positively suspend the liner by the holding cable in the event the pressure pads release a suspended liner.

4 Claims, 5 Drawing Figures

FIG. 1
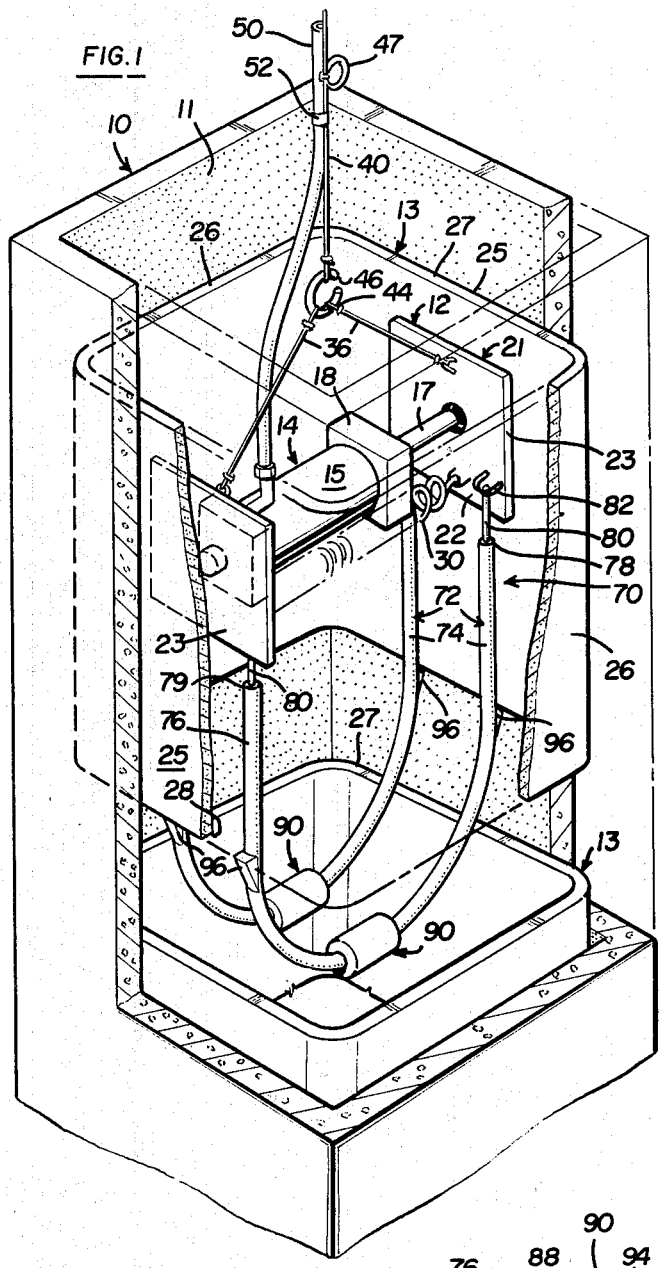
FIG. 2
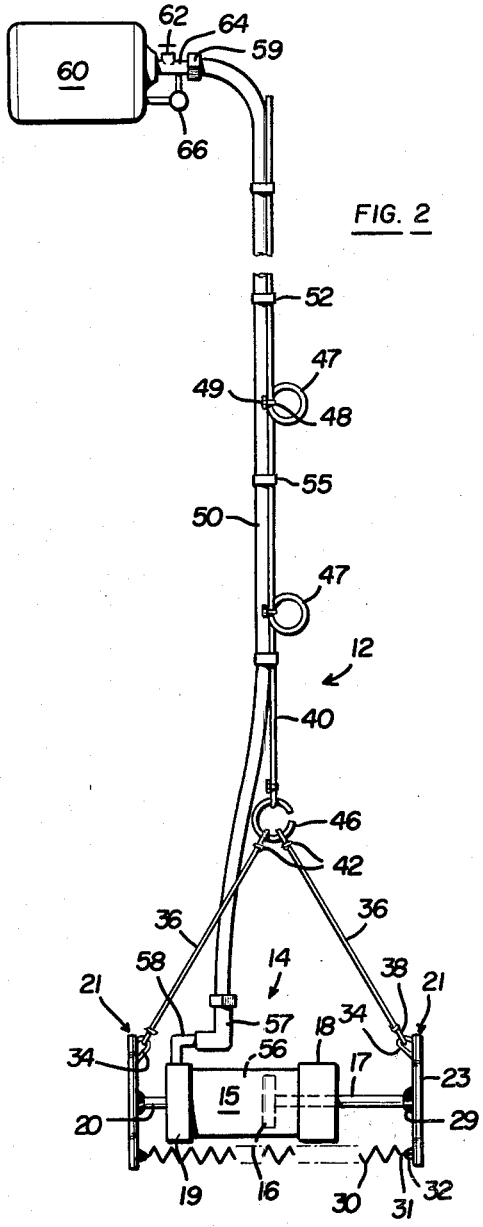
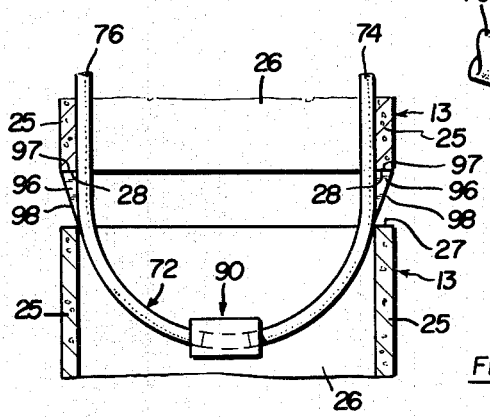
FIG. 3
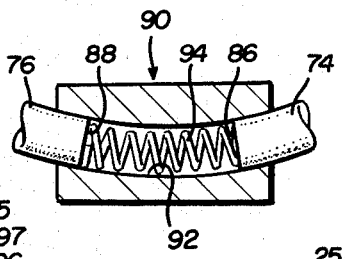
FIG. 4
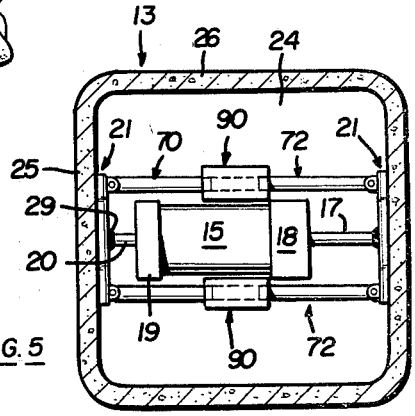
FIG. 5

DEVICE FOR LOWERING CERAMIC LINERS INTO A CHIMNEY

BACKGROUND OF THE INVENTION

Various lowering and positioning devices have been employed for general purposes, but there has been a need for a lowering device for use in relining an existing chimney flue passage with ceramic liners. In general, known devices for lowering or positioning are unacceptable for re-lining flue passages because they are inconvenient to transport and would be difficult to adapt to the various sized liners. Thus, there has been a need for an easily transportable flue relining device which may be used with various liners that is relatively inexpensive, while permitting one person to easily operate the device.

One of the problems encountered in relining an existing chimney flue passage is that the ceramic liner is an unstable body that cants or shifts away from the vertical axis of the flue passage as it is being lowered thereby causing misalignment of the core openings.

Another problem is that when a liner is being lowered the operator is unable to gauge its decent in the passage so as to readily indicate the arrival of the liner at its mortared joint with the next lowest course.

Another problem concerns the need for a fail-safe structure which is adpated to provide positive engagement between the liner and the lowering device until the lowered liner is positioned within the flue passage.

Thus, the invention herein relates to a device for lowering cored liners into an existing chimney flue during a relining operation or the like which solves these and other problems and limitations.

SUMMARY OF THE INVENTION

The invention herein contemplates an improved device for lowering ceramic liners into chimney flue passages that is easy to transport to the job site while allowing a single workman to operate the device. In general, the apparatus comprises a hydraulic support cylinder assembly adapted to be positioned crosswise within a liner core with the cylinder axis substantially normal to two opposite core walls. The cylinder includes a first elongated piston rod extending along the cylinder axis exterior of its one end with an axially movable piston providing outward rod travel relative to the one end. A second co-axial rod is fixed to the opposite end of the cylinder with both rods having pressure pad members secured at their outer free ends. A portable compressed air storage cylinder is provided having a control valve and pressure gauge to regulate the flow of air pressure to and from the cylinder. Upon the actuation of the piston rod to its extended position, the pressure pad members engage two opposite walls of the liner core to releasably clamp the cross support cylinder between the opposed walls.

A tension spring interconnects the pressure pad members and is operative for returning the piston rod to its retracted position upon the air pressure in the cylinder being reduced by the valve means below a predetermined amount. The cylinder and liner are lowered into the chimney flue passage by a holding cable having a coextensive flexible air supply hose connected to the cable by a plurality of clamps. A pair of cable lines provide a stirrup-like sling connection between a suspension ring on the lower end of the holding cable and the pressure pad members to suspend the liner in a plumb relation with the flue passage.

The holding cable is formed with a plurality of uniformly spaced closed gauging loops enabling the user to readily determine the vertical distance the liner has been lowered into the flue passage. The loops also serve as convenient hitches for anchoring the liner at known flue passage depths from a support. The loops are preferably spaced at linear intervals equal to the longitudinal dimension of the liner to enable the user to readily determine its arrival at the mortared joint with the next below liner.

A fail-safe feature of the present invention is provided wherein a pair of U-shaped pendants are suspended by their upwardly extending arms from the pressure pad members. Projections on the arms are adapted to abut the lower edges of the liner in the event that the pressure pad members release a suspended liner. A spring loaded expansion tube at the bight portions of the pendants telescopically couples opposed inner spaced ends of the arms. Upon positioning of the liner on the next below liner, the projections are forced inwardly telescoping the arms into the tube enabling the cylinder and fail-safe structure to be hoisted free of the flue passage.

Thus, it is an object of the present invention to provide an apparatus for lowering and stacking ceramic liners one upon another in a chimney flue in a minimum amount of time that is easily operated by one person.

It is another object of the present invention to provide improved apparatus for lowering and placing liners into an existing chimney flue passage that is compact and light-weight so as to be readily transportable to the job site.

It is another object of the present invention to provide a flue liner lowering apparatus as described above wherein the liner, clamped to a cross support cylinder, may be lowered into position so as to maintain the liner longitudinal axis in substantial coincidence with the holding cable of the device.

It is another object of the present invention to provide a fail-safe arrangement for the lowering apparatus described above providing a positive connection between the liner and the apparatus in the event that the pressure pad members release a suspended liner.

These and other objects and advantages of the invention will become apparent, upon reading the following description of which the attached drawings form a part.

BRIEF DESCRIPTION OF THE DRAWINGS

FIG. 1 is a perspective view of a portion of a chimney flue showing a liner being lowered therein with portions of the flue and liner broken away to show the lowering device of the present invention;

FIG. 2 is an elevational view of the lowering device of the present invention with the fail-safe structure removed;

FIG. 3 is a fragmentary detailed view of the fail-safe pendants in their engaged mode with a suspended liner;

FIG. 4 is an enlarged, fragmentary vertical sectional view of a fail-safe pendant coupling member of the present invention; and FIG. 5 is a horizontal sectional view taken through a liner showing the support cylinder and engaged fail-safe structure.

DETAILED DESCRIPTION OF THE INVENTION

Referring to FIG. 1, there is shown at 10 a portion of an existing chimney flue having a vertically disposed flue passage 11. Suspended within the flue passage is a portion of a lowering apparatus generally indicated at 12 for lowering ceramic flue liners 13 into the passage. The apparatus is particularly useful in a flue relining operation to replace existing flue liners which have developed leaks or the mortared joints no longer seal the passage.

As best seen in FIG. 2, the lowering apparatus 12 includes a support cylinder assembly generally indicated at 14. Actuating support cylinder 15 has a reciprocal piston 16 secured to an elongated piston rod 17 extending through an apertured end wall or block 18 of the piston cylinder. The opposite end of the cylinder is provided with an end wall or block 19 having a relatively short or stub-like fixed rod 20 extending therefrom in coaxial relation with the piston rod 17 such that the rods are aligned on the principal axis of the cylinder.

Each of the rods 17 and 20 have a pressure pad member 21 secured at its outer free end oriented substantially normal to the cylinder axis. The pressure pad members are identical and preferably rectangular or square in plan. Each pressure pad member includes a backing pressure plate 22 supporting an outer pressure pad 23 suitably affixed thereon as by an adhesive with the pads preferably formed from rubber or other elastomeric material.

The liners 13 are of standard construction and comprise substantially rectangular hollow blocks providing a longitudinal core 24 which extends therethrough from an upper opening to a lower opening. The liner includes a pair of opposed sidewalls 25 and a pair of opposed end walls 26 defining upper and lower edges 27 and 28 respectively. The pressure pad members are of a size relative to the liner core walls wherein the pressure pads 23 engage the intermediate planar area of a pair of opposed inner core walls. Pressure pad members 21 preferably have metal backing plates 22 connected to their associated rods by means of a swivel or ball and cup-like socket connection 29 to ensure that each pressure pad member contacts a liner core wall in a flush coplanar manner.

The cylinder assembly includes resilient biasing means in the form of tension spring 30 shown extending between the pressure pad members 21 with the longitudinal axis of the spring 30 oriented substantially parallel with the principal axis of the cylinder. The spring has its opposite ends affixed by hooks 31 engaging eye bolt connectors 32 suitably secured, as by welding adjacent opposite medial lower edge portions of the pressure plates in a vertical plane of symmetry that includes the cylinder axis.

FIG. 2 shows the upper medial edge portions of the plates having eye bolt connectors 34 secured thereto as by welding. Support cylinder assembly 14 is suspended from a pair of cable links 36 each having a spliced thimble eye 38 at a first lower end connected to an associated eye bolt 34 being sized to freely pivot within the bolt eye relative to the pressure plate. The cable links 36 provide a stirrup-like sling connection between the support cylinder pressure plates and the lower end of a holding cable 40. The cable links have upper ends provided with spliced thimble eyes 42 captivated in a freely slideable and pivotable manner on central suspension open ring 46. The stirrup-like sling load equalizing connection with the support cylinder enables lowering of the liner 13 in a self-centering plumbed manner with the holding cable 40 in substantial coaxial alignment with the liner core axis.

FIG. 2 shows the holding cable 40 formed with a series of uniformly spaced closed loops 47 located at defined equal intervals. Each of the loops is connected to cable 40 by means of a U-shaped clevis 48 and an adjustable lock 49.

The holding cable 40 is substantially coextensive with a flexible fluid supply hose 50. The cable 40 and hose 50 provide a holding line held in conjoined paired relation by suitable retainers such as conventional hose clamps 52 with the loops 47 extending from one side of the hose 50. In a typical arrangement the cable has an overall length of about 50 feet with the opposed loops equally spaced at substantially two foot intervals on their centers. The gage spacing between adjacent closed loops 47 is preferably equal to the overall longitudinal dimension of conventional chimney liner 13. This loop spacing allows the user to readily compute the depth of the liner within the flue passage.

The closed loops 47 further provide hitch connectors operative for engagement with a fixed support, not shown, such as a tripod positioned above the upper open end of the chimney passage 11. User may suspend or anchor the liner at a desired depth for pre-alignment between the motared edge 27 of a subjacent liner with the lower edge 28 of the suspended liner to insure a sealed joint therebetween.

As seen in FIG. 1 the cylinder assembly is clamped within the liner core adjacent its upper edge 27 to provide a stable load arrangement with the sling connection during the lowering operation. The piston rod 17 is actuated outwardly by the slideable piston 16 upon cylinder end chamber 56 being supplied with fluid, such as compressed air. The single air supply hose 50 has its lower end connected by elbow 57 to a common air inlet and venting outlet 58 which in turn is connected with the cylinder end wall or block 19 to the chamber 56.

The air supply hose 50 has its upper end connector 59 attached to a compressed air storage tank 60. Secured to the compressed air tank 60 is a master air supply control valve 62 connected to a fitting 64 on the tank. In the disclosed form of the invention, the support cylinder 15 is a single acting type wherein the chamber 56 progressively expands during the pistons outward power stroke with the piston 16 being moved to the right as viewed in FIG. 2. The pressure pads 23 are thus caused to engage the respective opposed walls 25 of the liner core providing positive pressurized contact wherein the support cylinder is held in a crosswise manner. The spring 30 is tensioned between the pressure plates 22 to continually urge the plates inwardly. A suitable pressure gage 66 is provided to enable the user to control the working pressure within predetermined limits.

Upon the suspended liner being stacked on a next adjacent lower course liner, with the liner cores and edges vertically aligned, the user operates the air supply control valve 62 to its venting position with air being allowed to escape from the cylinder chamber 56. The tensioned biasing spring 30 operates, upon the pressure falling below a predetermined value, to retract the piston rod 17 resulting in immediate release of the pressure pads 23 from clamping engagement with the core walls.

Turning now to a fail-safe structure, generally indicated at 70 in FIG. 1, there is provided a pair of identical pendants 72 suspended from corresponding portions of the pressure plates 22. As the pendants are identical only one will be described with like reference numbers being used to represent like or corresponding parts. Each pendant 72 is in a form of a flexible wire composite U-shaped member including a pair of upstanding arms 74 and 76. The arms have upper ends 78 and 79 connected by flexible straps 80 to their associated pressure plate corner portions by eye connectors 82.

The pendant 72 has its bight portion in the form of spaced opposed second inner ends 86 and 88 connected by a spring loaded expansion tubular couplar 90. As seen in FIG. 4 the bight portion inner ends 86 and 88 are telescopically received in the coupler through bore 92 having captured therebetween resilient means in the form of compression spring 94. Each arm 74 and 76 has suitable means, not shown, for retention in the bore 92.

Each arm 74 and 76 includes an outer projection 96 having an upper bearing face 97 adapted to abut the liner bottom edge 28. The projection faces 97 positively support the liner in the event the pressure pad members 21 become disengaged from a suspended liner prior to its lower edge 28 seating on a motared liner upper edge 27. It will be noted that the pressure pad members 21 are normally positioned within the liner core a sufficient distance below the liner top edge 27 such that the bearing faces 97 do not support the liner. The liner is thus suspended by the connection between the stirrup-like sling cable links 36 and the pressure pad members 21.

It is important to maintain slack in the pendant straps 80 to assure that only the pressure pad members transmit the weight of the liner to the sling connection enabling the liner to selfcenter itself in a plumb-like manner on the axis of the holding cable 40. If the pressure pad members release the liner during its descent the straps 80 will carry the load from the fail-safe pendants to the sling connection.

FIG. 3 shows the projections 96 in a form of wedge shape members having downwardly and inwardly inclined cam surfaces 98. The cam surfaces 98 are operative upon engagement by the upper edge 27 of the next below stacked liner to cause the pendant second ends 86 and 88 to be telescoped inwardly compressing springs 94. The coupler 90 allows the projections 96 to move inwardly a lateral distance sufficient to clear the liner bottom edge 28 enabling the support cylinder 14 and pendants 72 to pass upwardly within the liner core for hoisting from the flue passage 11.

It will be apparent to those skilled in the art that the foregoing disclosure is exemplary in nature rather than limiting, the invention being limited only by the appended claims.

I claim:

1. An apparatus for lowering rectangular cored liners into an existing flue passage, said apparatus comprising in combination:

a fluid actuated piston and support cylinder adapted to be positioned cross-wise within a liner core with the cylinder principal axis substantially normal to the liner walls;

said cylinder having a piston rod extending on the cylinder axis exterior of one end of said cylinder for reciprocal movement relative to said one end, and a rod extending on said principal axis from the opposite end of said cylinder;

a pressure pad member supported on the outer free end of each said rod;

a holding line consisting of a holding cable, a flexible fluid supply hose, and means for coupling said holding cable to said hose;

means to regulate the flow of fluid from said hose into said cylinder to extend said piston rod between a retracted position and an extended position, whereby said pressue pad members engage the opposite core walls to releasably clamp said cylinder to the liner;

spring biasing means interconnecting said pressure pad members operative for returning said piston rod to its retracted position upon said regulating means causing the fluid pressure in the cylinder to fall below a predetermined value;

sling means connecting said pressure pad members with one end of said holding cable;

said holding cable formed with a plurality of uniformly spaced closed loops disposed at predetermined intervals to enable the user to grasp the holding cable for controlling the gravity descent of the liner and cylinder; and wherein said loops provide gauge means enabling the user to readily compute the vertical descent of the liner within the flue passage, said loops operative for securing said holding cable to a support for anchoring the liner and support cylinder at predetermined intervals within the flue passage;

a pair of fail-safe U-shaped pendants adapted for suspension from said pressure members within the liner core;

each said U-shaped pendant having a pair of upwardly extending arms defining first ends, flexible strap means suspending each said arm first end from an associated pressure pad member;

each said U-shaped pendant having its bight portion in the form of spaced opposed second ends telescopically received in a tubular coupler through bore, said coupler through bore having resilient means therein operative to urge said pendant second ends outwardly such that the pendant arms are normally biased to press on the two opposite core walls, respectively, of the liner;

each said pendant arm having a projection thereon adapted to abut the liner bottom edge to positively support a suspended liner upon the pressure pad members releasing the liner; and said arm projections including cam means adapted upon contact by a subjacent positioned liner to telescope said pendant second ends inwardly whereby said projections are received within the liner core enabling said cylinder and pendants to be freely hoisted from the flue passage upon the retraction of said piston rod by said regulating means.

2. The apparatus as set forth in claim 1 wherein:

said holding cable one end having a suspension ring thereon;

said sling means in the form of a stirrup-like sling connection comprising a pair of cable links each having one end portion captivated by said suspension ring and with each said cable link having its opposite end portion attached in a freely pivotal manner to one of said pressure pad members wherein the suspended load carried by each said cable link being substantially equal.

3. The apparatus as set forth in claim 1, wherein said holding cable loops being spaced at defined intervals substantially equal to the overall longitudinal dimension of the liner.

4. The apparatus as set forth in claim 1 wherein:

each said pressure pad member in the form of an inner backing plate having an outer resilient pressure pad thereon;

each said rod means outer free end connected to said backing plate by a ball and cup-like joint, whereby said pressure pad members are adapted for limited pivotal movement to insure the pressure pads being oriented in flush contact with opposite core walls of the liner.

* * * * *